US012129584B2

(12) United States Patent
Ishihara et al.

(10) Patent No.: US 12,129,584 B2
(45) Date of Patent: Oct. 29, 2024

(54) OPERATION INFORMATION ACQUISITION DEVICE, OPERATION INFORMATION ACQUISITION METHOD, AND OPERATION INFORMATION COLLECTION SYSTEM

(71) Applicant: JUKI CORPORATION, Tama (JP)

(72) Inventors: Kazuyuki Ishihara, Tokyo (JP); Keiji Wada, Tokyo (JP)

(73) Assignee: JUKI CORPORATION, Tama (JP)

( * ) Notice: Subject to any disclaimer, the term of this patent is extended or adjusted under 35 U.S.C. 154(b) by 822 days.

(21) Appl. No.: 17/212,119

(22) Filed: Mar. 25, 2021

(65) Prior Publication Data

US 2021/0301440 A1 Sep. 30, 2021

(30) Foreign Application Priority Data

Mar. 27, 2020 (JP) ..... 2020-058169

(51) Int. Cl.
*D05B 19/04* (2006.01)
*D05B 19/12* (2006.01)
*D05B 69/10* (2006.01)

(52) U.S. Cl.
CPC ..... *D05B 19/04* (2013.01); *D05B 19/12* (2013.01); *D05B 69/10* (2013.01)

(58) Field of Classification Search
CPC ..... D05B 19/04; D05B 19/12; D05B 69/10; D05C 5/00; D05C 5/02
See application file for complete search history.

(56) References Cited

U.S. PATENT DOCUMENTS 5,974,992 A * 11/1999 Asano ..... D05B 19/02 112/155
2001/0004717 A1* 6/2001 Zhang ..... D05C 5/00 700/136

(Continued)

FOREIGN PATENT DOCUMENTS

CN 109554833 A 4/2019
GB 2059636 A 4/1981

(Continued)

OTHER PUBLICATIONS

Extended European Search Report issued Aug. 2, 2021 in European Patent Application No. 21165095.7.

(Continued)

*Primary Examiner* — Nathan E Durham
(74) *Attorney, Agent, or Firm* — Faegre Drinker Biddle & Reath LLP

(57) ABSTRACT

The operation information acquisition device includes the external detection device which is provided on the outer side of the main body frame of the sewing machine and detects the state change of the operating member that performs the periodic operation at the same cycle as the up-down movement operation of the sewing needle, the operation information acquisition device acquires operation information based on detection result of the external detection device. The operation information acquisition device can acquire the operation information such as the "number of stitches", the "operating hours", the "sewing speed", and the "number of times of thread cutting".

16 Claims, 19 Drawing Sheets

(56) References Cited

U.S. PATENT DOCUMENTS

| | | | | |
|---|---|---|---|---|
| 2006/0027152 | A1* | 2/2006 | Iida | D05B 19/12 112/286 |
| 2007/0272136 | A1 | 11/2007 | Shimizu | |
| 2019/0003094 | A1* | 1/2019 | Fujimoto | G05B 19/182 |

FOREIGN PATENT DOCUMENTS

| | | | |
|---|---|---|---|
| JP | H01-173826 | A | 7/1989 |
| JP | 5957323 | B2 | 7/2016 |
| JP | 2022-515939 | A | 2/2022 |
| WO | WO-2019/054567 | A1 | 3/2019 |
| WO | WO-2021/107251 | A1 | 6/2021 |

OTHER PUBLICATIONS

Japan Office Action issued Oct. 3, 2023, in Japan Application No. 2020-058169.

* cited by examiner

OPERATION INFORMATION ACQUISITION DEVICE, OPERATION INFORMATION ACQUISITION METHOD, AND OPERATION INFORMATION COLLECTION SYSTEM

CROSS-REFERENCE TO RELATED APPLICATIONS

The present application claims the benefit of priority of Japanese Patent Application No. 2020-058169, filed on Mar. 27, 2020, the content of which is incorporated herein by reference.

TECHNICAL FIELD

The present invention relates to an operation information acquisition device, an operation information acquisition method, and an operation information collection system.

BACKGROUND

In sewing factories or the like, it is necessary to manage operation information of sewing machines which are in use. Therefore, the operation information was recorded for each sewing machine, and the operation information of each machine was collected (for example, refer to U.S. Pat. No. 5,957,323).

SUMMARY

However, in the sewing factories, in many cases, various types of sewing machines with different manufacturers, specifications, and production year exist alongside and are operated, and the sewing machines which do not have a function of detecting the operation information also exist alongside. An operation information collection system of the related art has a problem that it is not possible to collect the operation information in sewing machines which do not have a function of detecting the operation information.

An object of the present embodiment is to provide an operation information collection system and an operation information acquisition device that can acquire operation information regardless of the type of sewing machine.

An aspect of the present embodiment is an operation information acquisition device comprising:

an external detection device which is provided on an outer side of a main body frame of a sewing machine and detects a state change of an operating member that performs a periodic operation at a same cycle as an up-down movement operation of a sewing needle, wherein the operation information acquisition device acquires operation information based on detection result of the external detection device.

Another aspect of the present embodiment is an operation information collection system that collects operation information from a plurality of sewing machines, comprising:

an external detection device which is provided on an outer side of a main body frame of the sewing machine and detects a state change of an operating member that performs a periodic operation at a same cycle as an up-down movement operation of a sewing needle, with respect to some or all of the sewing machines, wherein the operation information collection system acquires the operation information based on detection result of the external detection device.

In the present embodiment, even in a case of the sewing machines which do not have a function of detecting necessary parameters and externally outputting the operation information due to differences in equipment or specifications, it is possible to install the external detection device outside the sewing machine as a retrofit, and to acquire the operation information based on the detection result, with respect to the operating member.

Furthermore, even in an environment with a wide variety of sewing machines with different manufacturers, different equipment or specifications, different models, different manufacturing year, and the like, it is possible to acquire the operation information from all or most of these sewing machines, and to grasp the operation status of all or most of the sewing machines belonging to a predetermined unit classification, such as a factory or an organization.

DESCRIPTION OF EMBODIMENTS

[Outline Configuration of Sewing Management System]

Figure 1:
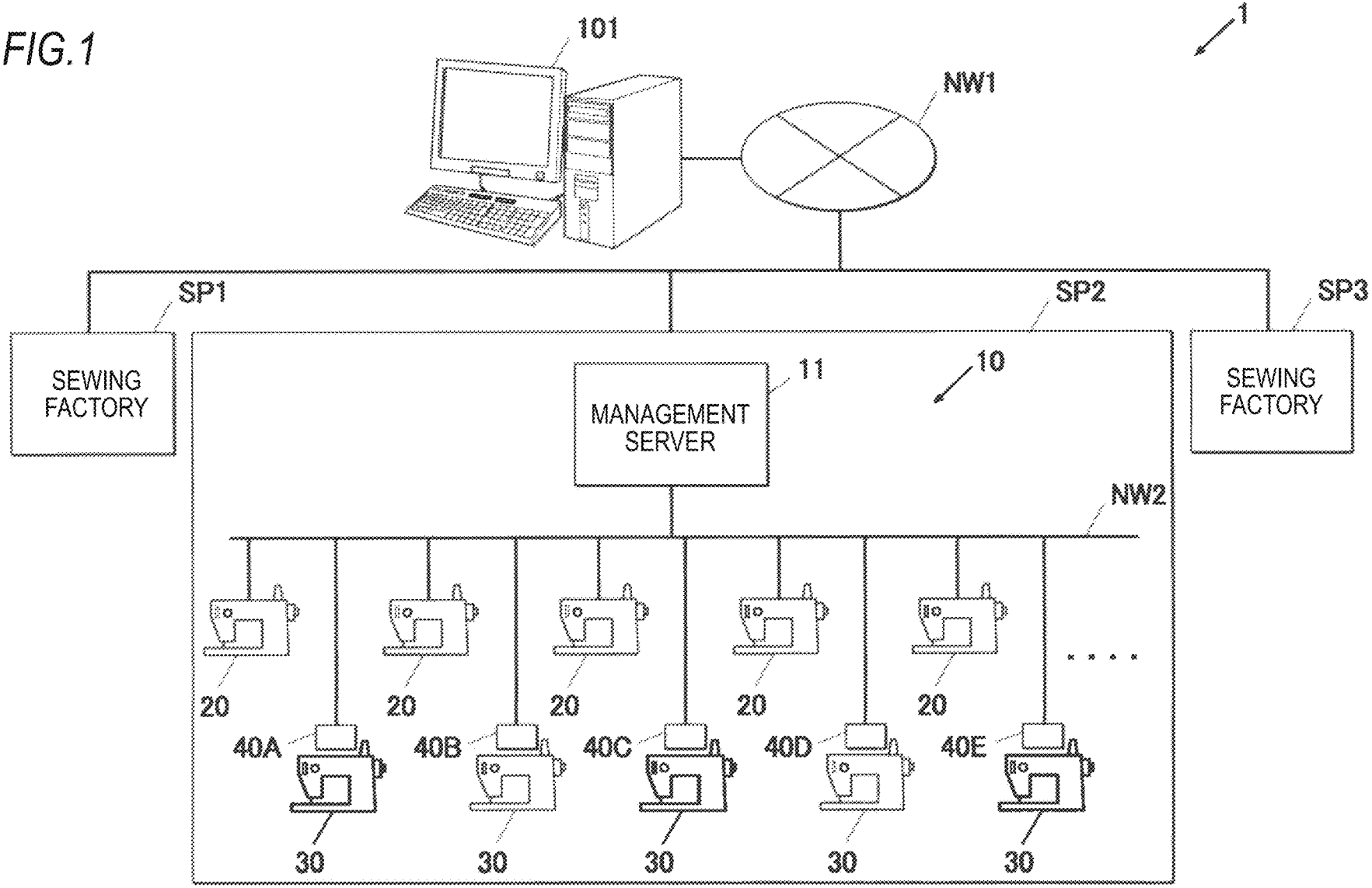
FIG. 1 is a configuration view of a sewing management system according to an embodiment of the present invention.

FIG. 1 is a configuration view of a sewing management system 1 according to an embodiment of the present invention. As illustrated in FIG. 1, the sewing management system 1 includes: an operation information collection system 10 built for each sewing factory for sewing machines belonging to sewing factories SP1 to SP3; and a management terminal 101 connected to the respective operation information collection system 10. Since the configurations of the operation information collection systems 10 for the sewing factories SP1 to SP3 are the same, the configuration of the operation information collection system 10 for only the sewing factory SP2 will be illustrated in FIG. 1, and the operation information collection systems 10 of the sewing factories SP1 and SP3 will be omitted.

The operation information collection systems 10 of each of the factories SP1 to SP3 are connected to the management terminal 101 through a network NW1 such as the Internet. All the operation information collected by the operation information collection systems 10 of each of the factories SP1 to SP3 can be transmitted to or viewed by the management terminal 101, and the administrator can confirm the operating situation and the like of each of the sewing factories SP1 to SP3 from the management terminal 101.

By confirming the operating situation and the like, the administrator can change the setting of various parameters related to sewing in each of the sewing factories SP1 to SP3 through the management terminal 101, for example.

The management terminal 101 is configured with a general personal computer (PC), a tablet PC, a smart device (smartphone, smart watch, or smart glasses) and the like.

In each of the factories SP1 to SP3, a plurality of sewing machines with different manufacturers, models, specifications, and production year configure the sewing line.

Strictly speaking, the plurality of sewing machines that configure the sewing line are diverse, but these sewing machines can be generally classified into two types, such as a sewing machine 20 and a sewing machine 30.

In other words, in the sewing machine 20 belonging to one of the classifications, a mounting-type detection device that detects the state change of the configuration of the sewing machine is mounted, and a function of outputting the detection information and the operation information based on the detection information to the outside is provided. The term "mount" here means that the sewing machine is provided from the beginning, and does not include detection devices that have been added later by modification or the like, or external detection devices that are not provided in the sewing machine.

In the sewing machine 30 belonging to the other classification, the mounting-type detection device that detects the state change of the configuration of the sewing machine is not provided, and the function of outputting the detection information of the mounting-type detection device and the operation information based on the detection information to the outside is not provided.

The operation information collection system 10 of each of the factories SP1 to SP3 includes: the plurality of sewing machines 20 belonging to the sewing line; the plurality of sewing machines 30 belonging to the sewing line; operation information acquisition devices 40 which are separately provided in each of the sewing machines 30; and a management server 11 as a collection device that collects the operation information from each of the sewing machines 20 and collects the operation information through the operation information acquisition device 40 from each of the sewing machines 30.

The management server 11, each sewing machine 20, and each operation information acquisition device 40 are connected to a network NW2 of the operation information collection system 10.

Each of the sewing machines 20 and 30 includes: a main shaft motor, a main shaft that is rotationally driven by the main shaft motor; a needle bar 306 and a sewing needle 307 (refer to FIG. 4) that reciprocate and move up and down by obtaining power from the main shaft; a thread take-up lever member 304 (refer to FIG. 4) that moves up and down at the same cycle as the needle bar 306; a shuttle or a looper that entangles the lower thread with the upper thread of the sewing needle 307; a cloth feed mechanism that feeds cloth at a predetermined stitch pitch; and a thread cutter that cuts the upper thread and the lower thread.

Figure 2:
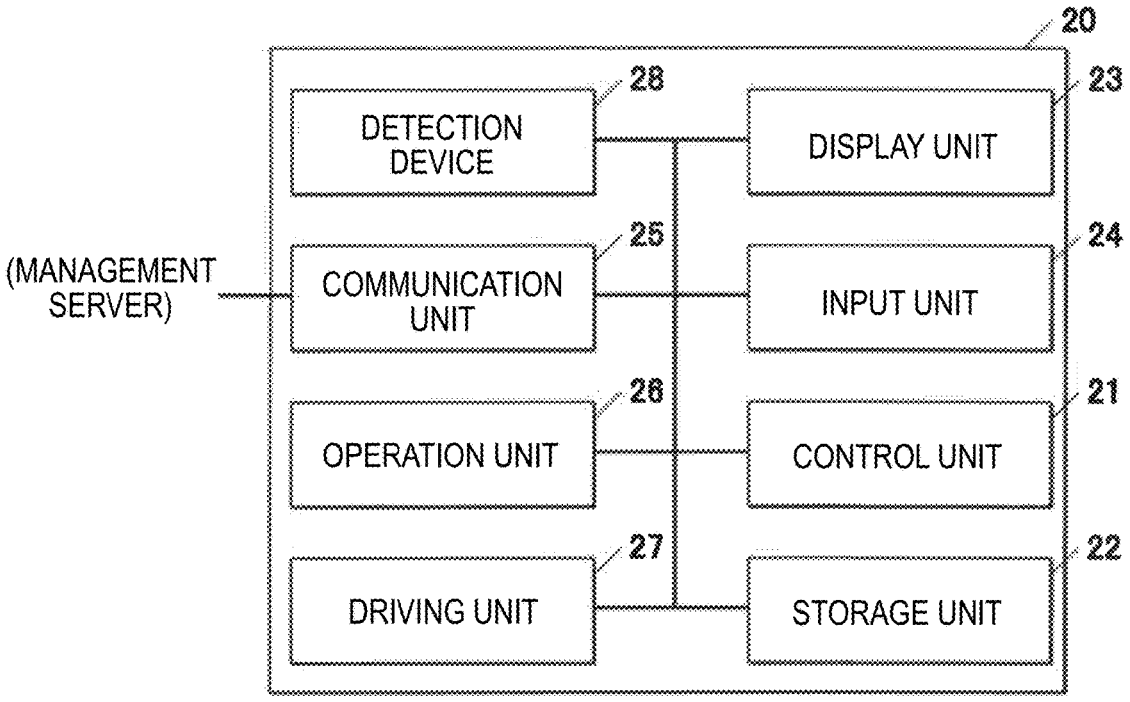
FIG. 2 is a block diagram illustrating a control system of a sewing machine.

FIG. 2 is a block diagram illustrating a control system of the sewing machine 20.

As illustrated in the drawing, each of the sewing machines 20 includes a control unit 21 that controls the entire sewing machine 20, and a storage unit 22, a display unit 23, an input unit 24, a communication unit 25, an operation unit 26, and a driving unit 27 which are connected to the control unit 21.

The control unit 21 is configured with a central processing unit such as a CPU. The storage unit 22 stores the program executed by the control unit 21 and functions as a work region of the control unit 21.

The display unit 23 displays information necessary for the operation of the sewing machine 20.

The input unit 24 receives an input of an instruction or setting from the operator.

The communication unit 25 communicates with the management server 11 via the network NW2. For example, the communication unit 25 sends the operation information of the sewing machine 20 to the management server 11.

The operation unit 26 receives the operation related to the sewing, from the operator. For example, the operation unit 26 receives sewing the driving operation (for example, execution of sewing start, sewing stop, feeding, thread cutting and the like) of the sewing from the operator.

The driving unit 27 includes the above-described main shaft motor, an actuator that executes the thread cutting, an actuator that changes the stitch pitch, and other drive sources for various sewing-related operations.

The detection device 28 is a mounting-type detection device mounted on the sewing machine 20, and is a sensor type that detects the detection information for acquiring the operation information. Here, the "operating hours", the "number of stitches", the "sewing speed", the "number of times of thread cutting", and the "volume" are illustrated as examples of operation information, but other information can also be acquired.

The detection device 28 is an encoder that detects the rotation speed of the main shaft motor. Depending on the type of operation information, other detection devices may be added.

The "operating hours" as operation information is the elapsed time from the start to the stop of sewing. The encoder can detect the start and the stop of the driving of the main shaft motor, and the control unit 21 can acquire the "operating hours" by measuring the elapsed time between the start and the stop of the driving.

The "number of stitches" as operation information is the total number of stitch points during the sewing. It is possible to acquire the total value of the rotation speed of the main shaft motor, which is detected by the encoder.

The "sewing speed" as operation information is the average number of stitch points per unit time during the sewing. The "sewing speed" can be acquired from the rotational speed of the main shaft motor, which is detected by the encoder.

The "number of times of thread cutting" as operation information is the cumulative number of times of execution of thread cutting. The "number of times of thread cutting" can be acquired by counting the input of the thread cutting command, which is detected by the operation unit 26.

The "volume" as operation information is the number of sewn objects to which the sewing is completed. Since the number of times of thread cutting performed with respect to one sewn object is determined, the "volume" is obtained by dividing the "number of times of thread cutting" by the number of times of thread cutting performed with respect to one sewn object. The number of times of thread cutting to be performed with respect to one sewn object can be set and input in advance by the input unit 24.

Each of the above-described operation information is acquired by collating the timepiece built in the control unit 21 by the detection by the detection device 28 or the like, and is temporarily stored in the storage unit 22. The control unit 21 transmits the acquired operation information to the management server 11 periodically or at a specified time or upon the request from the management server 11.

Meanwhile, each of the sewing machines 30 is not limited to the same model, and the configuration thereof may differ individually. Each of the sewing machines 30 includes at least the operation unit and the driving unit similar to the sewing machine 20, but none of the sewing machines 30 has a detection device for acquiring the operation information or the communication unit that transmits the information to the outside. Therefore, each of the sewing machines 30 cannot transmit the operation information to the management server 11.

Therefore, each of the sewing machines 30 has either an operation information acquisition device 40A or 40B separately attached thereto for acquiring the operation information from the outside of the sewing machine.

[Operation Information Acquisition Device]

Figure 3:
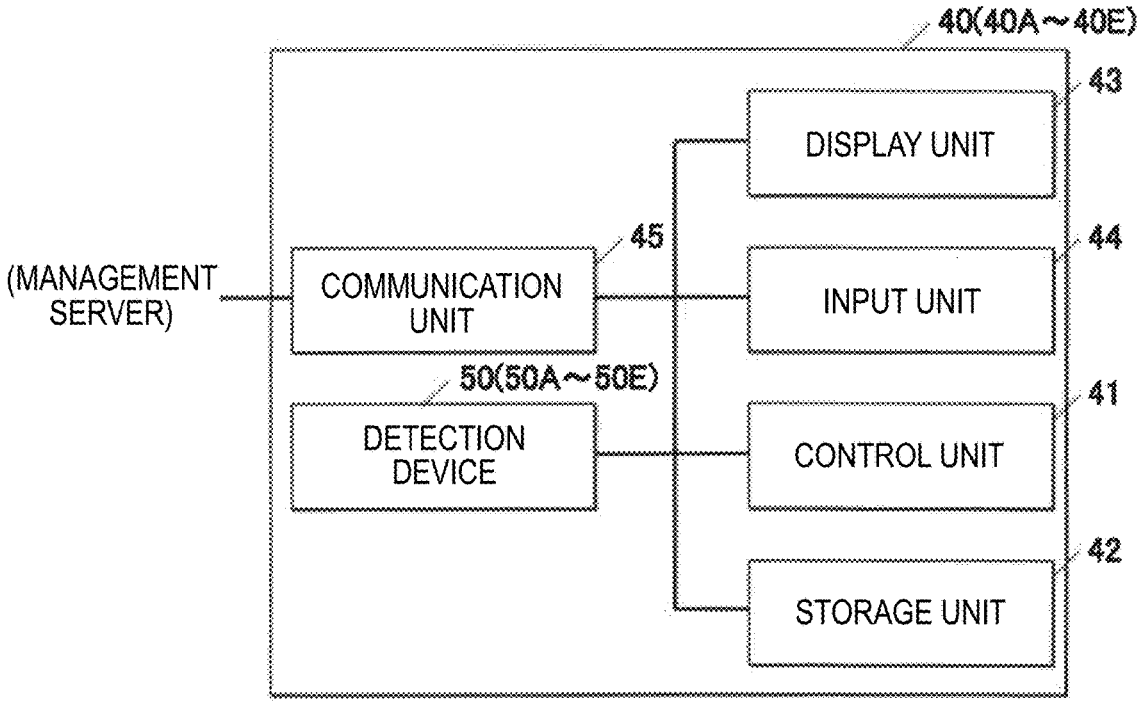
FIG. 3 is a block diagram illustrating a control system of an operation information acquisition device.

FIG. 3 is a block diagram illustrating a control system of the operation information acquisition device 40. As the operation information acquisition device 40, five types of operation information acquisition devices 40A to 40E are exemplified, but in a case of describing the common contents, duplicate description will be omitted by describing "operation information acquisition device 40". In a case of describing the different points, the operation information acquisition devices 40A, 40B, 40C, 40D, and 40E will be described separately.

As illustrated in FIG. 3, the operation information acquisition device 40 includes a control unit 41 that executes processing or control for acquiring predetermined detection information, and a storage unit 42, a display unit 43, an input unit 44, a communication unit 45, and a detection device 50 which are connected to the control unit 41.

The control unit 41 is configured with a central processing unit such as a CPU. The storage unit 42 stores the program executed by the control unit 41 and functions as a work region of the control unit 41. In the storage unit 42, an acquisition device ID dedicated to the operation information acquisition device 40 and a sewing machine ID assigned to the sewing machine 30 to which the operation information acquisition device 40 is attached, are recorded.

The display unit 43 displays the information or setting values necessary to acquire the operation information.

The input unit 44 receives an input of the setting values necessary to acquire the operation information from the operator.

The communication unit 45 communicates with the management server 11 via the network NW2. For example, the communication unit 45 transmits the detection information and the operation information, which are detected from the sewing machine 30, to the management server 11.

The detection device 50 is an external detection device that performs detection related to the sewing operation of the sewing machine 30 from the outside of a main body frame 301, and is a sensor type that detects the detection information for acquiring the operation information of the sewing machine 30. The details of the sensor type will be described later.

The operation information acquired by the operation information acquisition device 40 includes the "operating hours", the "number of stitches", the "sewing speed", the "number of times of thread cutting", and the "volume" (some of the operation information acquisition devices 40A to 40E can only acquire some of these operation information). These definitions are the same as those for the above-described sewing machine 20. The operation information also includes information other than the above-described information. A method by which the operation information acquisition device 40 acquires these operation information will be described later.

The operation information acquisition devices 40A to 40E differ in the detection device 50. In the following description, the detection devices of the operation information acquisition devices 40A to 40E are referred to as detection devices 50A to 50E, respectively.

The detection device 50A of the operation information acquisition device 40A includes: a photoelectronic sensor 51A (refer to FIG. 4) which is provided on the outer side of the main body frame 301 of the sewing machine 30 and detects the state change of the operating member that performs the periodic operation at the same cycle as the up-down movement operation of the sewing needle 307; a current sensor 53 (refer to FIG. 6) which serves as a current detection device that detects the energization from the outer side of a current cable 302 in which the motor current of the main shaft motor drawn to the outside from the main body frame 301 flows; an optical sensor 54 (refer to FIG. 7) which serves as a light detection device that detects the light emitting state of a power lamp 303, which is a light emitting unit that emits light when the main power of the sewing machine 30 is turned on; and a volume switch 56 (refer to FIG. 17) which serves as a volume input unit that detects the volume by an operation of the operator who works with the sewing machine.

The operation information acquisition device 40A includes at least the photoelectronic sensor 51A as the detection device 50A, but does not include the current sensor 53, the optical sensor 54, or the volume switch 56 in some cases.

Figure 4:
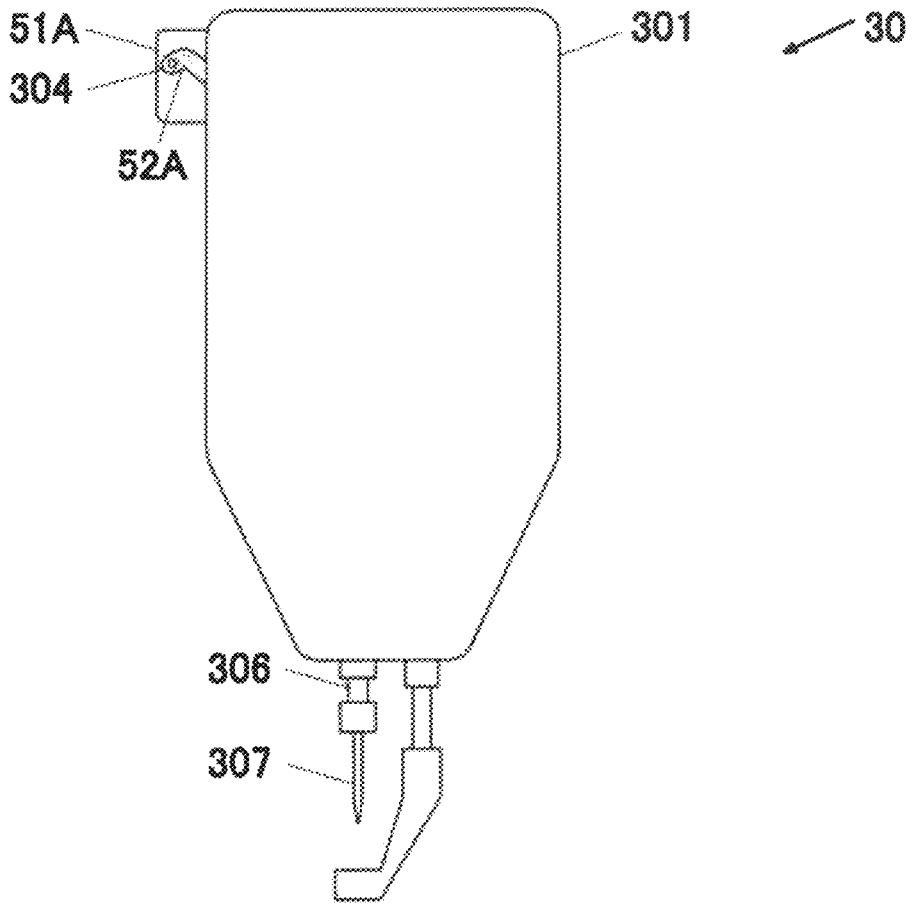
FIG. 4 is a partial side view of the sewing machine illustrating an installation example of a photoelectronic sensor and illustrates a detection state of the photoelectronic sensor.
Figure 5:
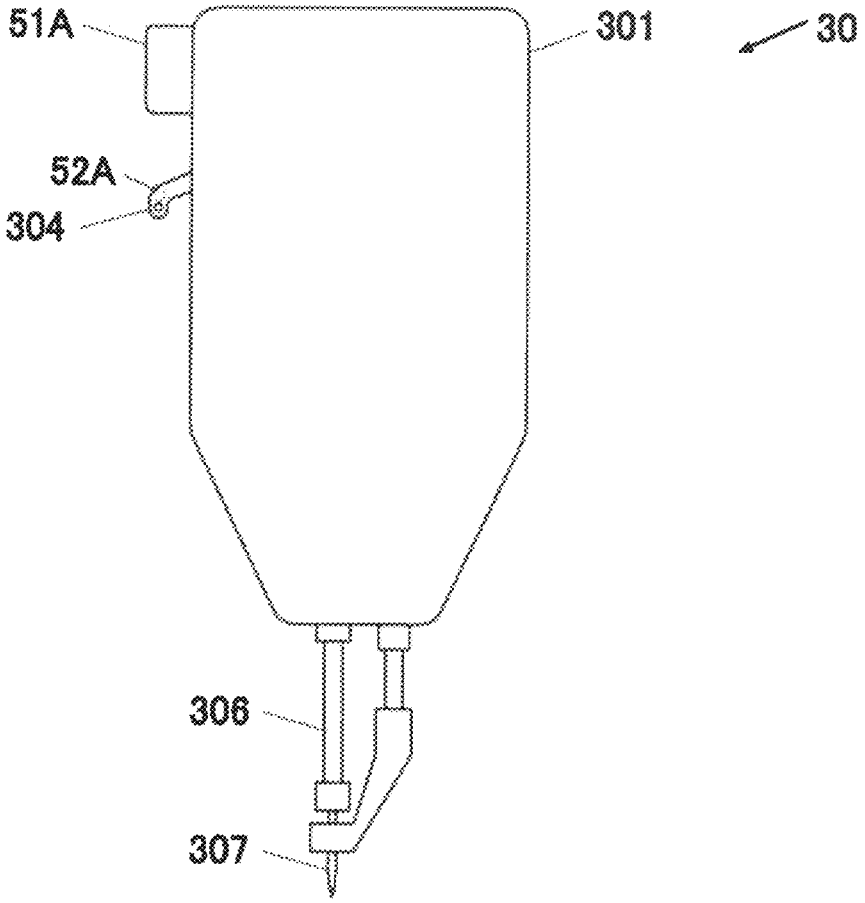
FIG. 5 is a partial side view of the sewing machine illustrating an installation example of a photoelectronic sensor and illustrates a non-detection state of the photoelectronic sensor.

FIGS. 4 and 5 are partial side views of the sewing machine 30 illustrating the installation examples of the photoelectronic sensor 51A on the sewing machine 30, FIG. 4 illustrates a detection state of the photoelectronic sensor 51A, and FIG. 5 illustrates a non-detection state.

The photoelectronic sensor 51A detects the presence or absence of the thread take-up lever member 304 as an operating member that performs the periodic operation at the same cycle as the up-down movement operation of the sewing needle 307.

The thread take-up lever member 304 is extended to the outside on the front side (a surface facing the operator) of the arm portion of the main body frame 301 at the tip end portion at which a threading hole passing the upper thread is formed. The thread take-up lever member 304 obtains power from the rotation of the main shaft, and the tip end portion thereof performs the up-down reciprocating oscillating motion at the same cycle as the up-down movement of the sewing needle 307.

The top dead point in the reciprocating oscillating motion of the thread take-up lever member 304 matches the needle bar upper stop position (the sewing needle 307 stops in a state of being retracted above the throat plate) which is a stop position of the main shaft when the sewing machine 30 finishes the sewing.

The photoelectronic sensor 51A is a reflective type including a light emitting element and a light receiving element which face the same direction, and can detect the presence or absence of an object directly facing the detection surface by the presence or absence of the reflected light. The photoelectronic sensor 51A is attached to the external front side of the arm portion of the main body frame 301 such that the detection surface thereof is directly opposite to the position where the tip end portion of the thread take-up lever member 304 at the top dead point can be detected. A reflective sheet 52A is provided at the tip end portion of the thread take-up lever member 304 in an arrangement opposite to the photoelectronic sensor 51A. Even without the reflective sheet 52A, the photoelectronic sensor 51A can detect the tip end portion of the thread take-up lever member 304, but by providing the reflective sheet 52A, more excellent detection can be performed.

The photoelectronic sensor 51A can be fixed by using any of the methods available, such as gluing, screwing, or screwing through a bracket. The photoelectronic sensor 51A may not be directly attached to the surface of the main body frame 301, and for example, may be configured to be supported by a support erected on the front side of the main body frame 301 of the sewing machine 30.

The detection means of the tip end portion of the thread take-up lever member 304 is not limited to a reflective type photoelectronic sensor, but may also utilize a transmissive type photoelectronic sensor. Furthermore, not only the photoelectronic sensor 51A, but also any sensor that can detect the presence or absence of the tip end portion of the thread take-up lever member 304 can be used. For example, a distance detection sensor may detect the approach of the tip end portion of the thread take-up lever member 304, or a sensor that uses magnetism or ultrasound to detect the approach of the tip end portion of the thread take-up lever member 304 may be used.

Here, the detection examples of signals of the photoelectronic sensor 51A are illustrated in FIGS. 8 to 13. Based on the drawings, the acquisition method of each operation information will be described. In FIGS. 8 to 13, the detection state of the tip end portion of the thread take-up lever member 304 by the photoelectronic sensor 51A is L and the non-detection state is H.

Figure 8:
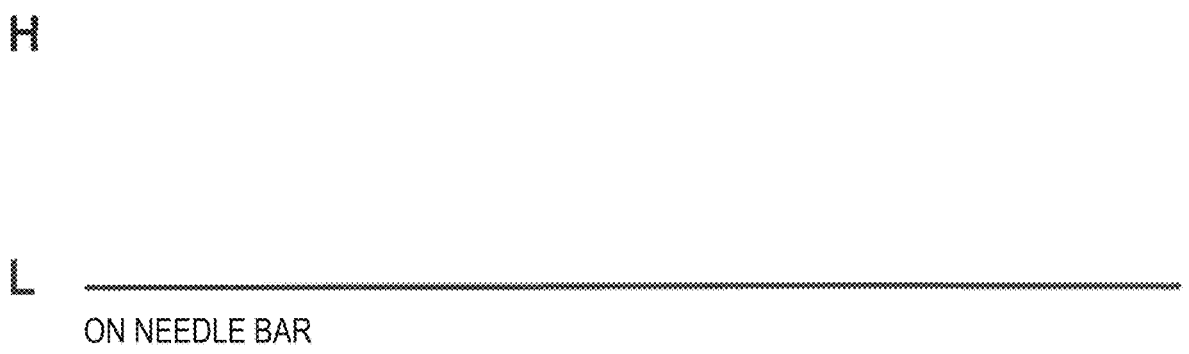
FIG. 8 is an output line diagram illustrating a detection example of a signal of the photoelectronic sensor.

As illustrated in FIG. 8, in a case where the detection of the photoelectronic sensor 51A continues in the L state, a state where the main shaft motor is stopped at the needle bar upper stop position is illustrated.

Figure 9:
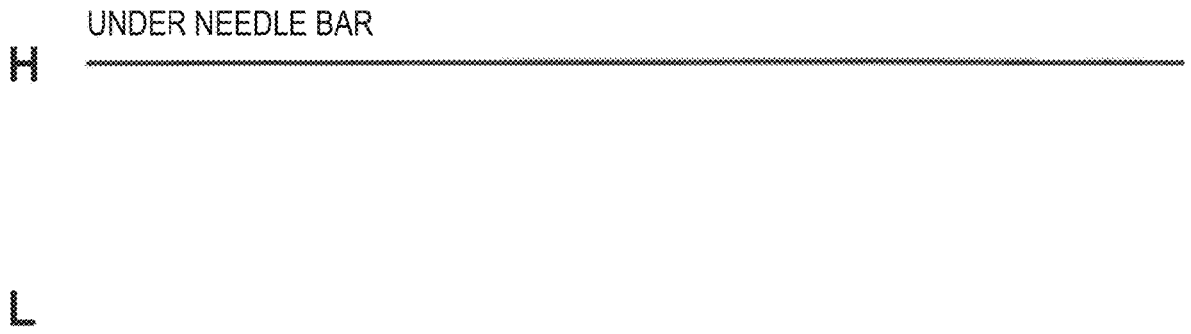
FIG. 9 is an output line diagram illustrating a detection example of the signal of the photoelectronic sensor.

As illustrated in FIG. 9, in a case where the detection of the photoelectronic sensor 51A continues in the H state, a state where the main shaft motor is stopped at the needle bar lower stop position is illustrated.

Figure 10:
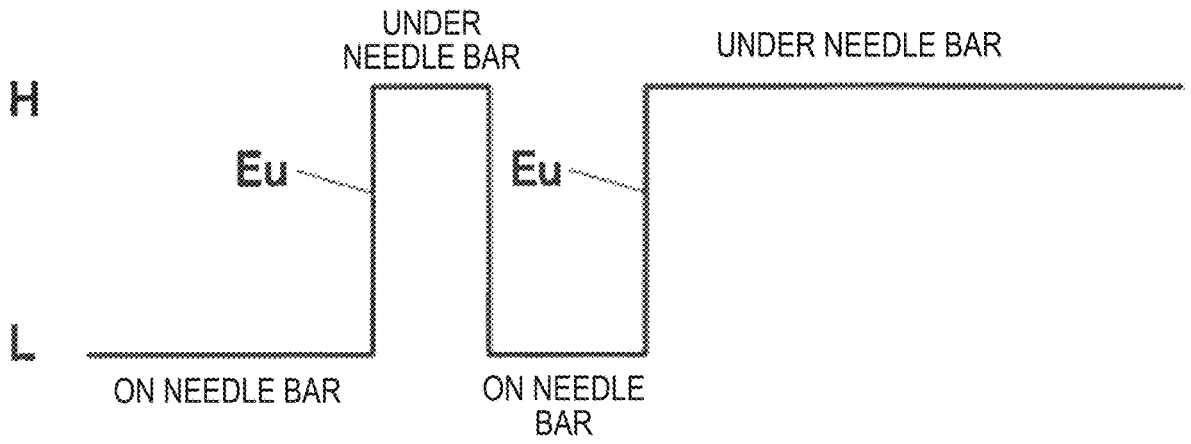
FIG. 10 is an output line diagram illustrating a detection example of the signal of the photoelectronic sensor.
Figure 11:
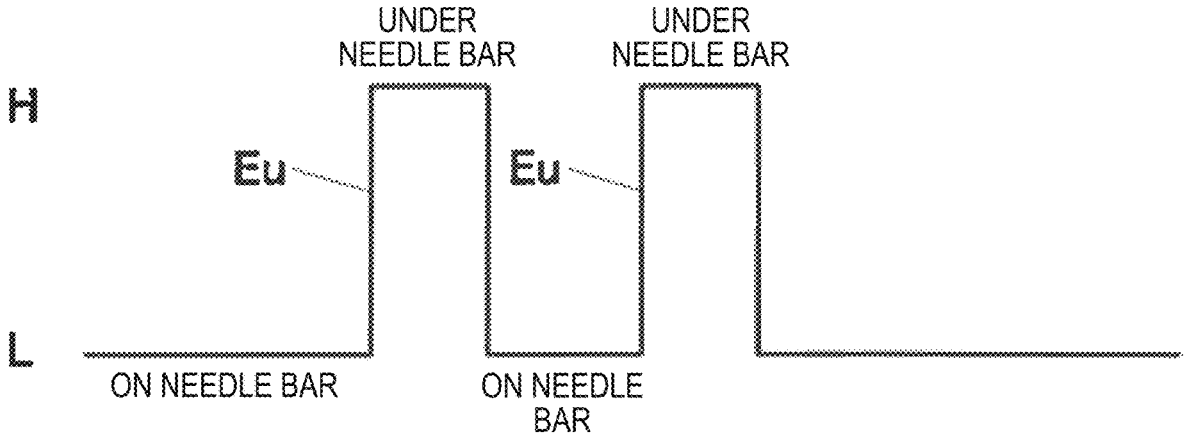
FIG. 11 is an output line diagram illustrating a detection example of the signal of the photoelectronic sensor.
Figure 12:
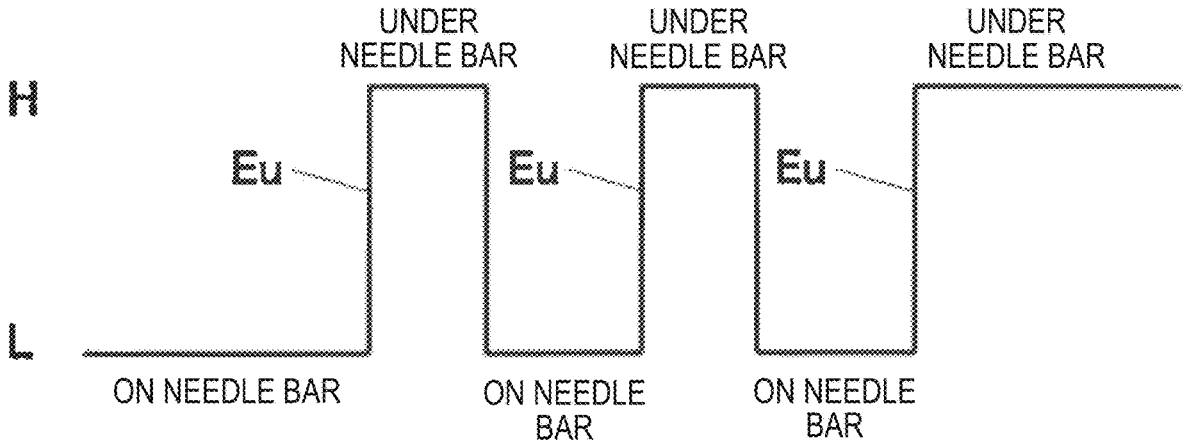
FIG. 12 is an output line diagram illustrating a detection example of the signal of the photoelectronic sensor.

As illustrated in FIGS. 10 to 12, in a case where the detection of the photoelectronic sensor 51A repeats the H state and the L state at a short cycle, the control unit 41 can detect the "number of stitches" by counting the number of times of rising edge Eu indicating the switch from the L state to the H state.

For example, the number of stitches is counted as 2 because the rising edge Eu occurs twice and stops in a case of FIG. 10, the number of stitches is also similarly counted as 2 in a case of FIG. 11, and the number of stitches is counted as 3 in a case of FIG. 12.

The control unit 41 can determine that the main shaft motor is stopped in a case where the continuation of the L state or the H state for a predetermined stop determination time t1 or longer is detected. The stop determination time t1 for determining this stop can be set in any manner from the input unit 44. For example, the stop determination time t1 is set to a value equal to 0.6 [s], which is the cycle at a main shaft rotation speed of 100 [spm], which is a sufficiently low speed at which normal sewing is not performed.

The control unit 41 can measure the elapsed time from the detection of the first rising edge Eu to the last rising edge Eu immediately before the stop, and acquire the "operating hours" from this elapsed time.

Furthermore, the control unit 41 can acquire the "sewing speed" by dividing the acquired "number of stitches" by the acquired "operating hours".

For example, in a case of FIG. 10, the detection of the photoelectronic sensor 51A continues in the H state when being stopped, and thus, the control unit 41 determines that the stop is made at the needle bar lower stop position. Meanwhile, in a case of FIG. 11, the detection of the photoelectronic sensor 51A continues in the L state when being stopped, and thus, the control unit 41 determines that the stop is made at the needle bar upper stop position.

When being stopped at the needle bar lower stop position, a state where the sewing needle 307 thrusts into the cloth and is restrained is maintained, and after this, the sewing is generally resumed by changing direction, and the like. In contrast, stopping at the needle bar upper stop position means a state where the cloth is released from the restraint by the sewing needle 307, and generally, the sewing is finished and the process is moved to the thread cutting.

Therefore, in a case of stopping at the needle bar upper stop position as illustrated in FIG. 11, the control unit 41 considers that the thread cutting is executed, counts the "number of times of thread cutting" and can acquire the value of the "number of times of thread cutting".

The photoelectronic sensor 51A and the reflective sheet 52A (or the thread take-up lever member 304) are configured to detect the upper stop position of the thread take-up lever member 304, but it is also possible to detect the needle bar lower stop position by changing the arrangement (the same applies to a photoelectronic sensor 51B described below). In this case, instead of counting the "number of times of thread cutting" by detecting the stop at the needle bar upper stop position, the "number of times of thread cutting" can be counted by detecting the stop in a state where the needle bar lower stop position is not detected.

Similar to a case of the sewing machine 20, since the number of times of thread cutting performed with respect to one sewn object is determined, the control unit 41 calculates the "volume" by dividing the "number of times of thread cutting" by the number of times x of thread cutting performed with respect to one sewn object. The number of times x of thread cutting to be performed with respect to one sewn object can be set and input in advance in any manner by the input unit 44.

Figure 13:
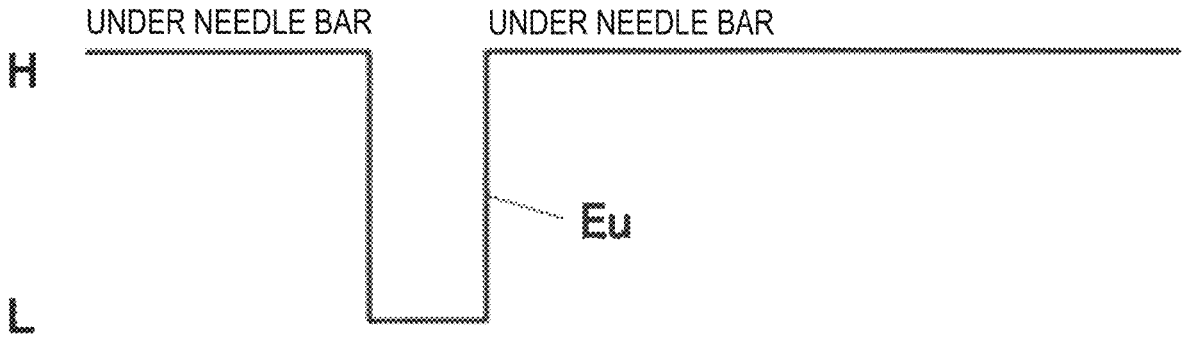
FIG. 13 is an output line diagram illustrating a detection example of the signal of the photoelectronic sensor.

FIG. 13 illustrates the detection signal of the photoelectronic sensor 51A in a case where inching is performed. Inching is sewing performed at low speed, one stitch at a time, in order to align the stitch point position at corners and the like.

Since the inching is the stitching for one stitch in the middle of sewing, the stitching for one stitch is performed in a state of being stopped at the needle bar lower stop position, and the inching is stopped again at the needle bar lower stop position. Therefore, while the detection of the photoelectronic sensor 51A is stopped in the H state, the rising edge Eu is detected once, and again, the stop is detected in the H state, and accordingly, it is possible to detect the execution of the "inching".

During the inching, the rising edge Eu is detected only once, and thus, the "number of stitches" becomes 1, the above-described "operating hours" cannot be obtained, and accordingly, the "sewing speed" cannot be obtained. Here, in consideration of the fact that the inching is generally performed at an extremely low speed, it is assumed that the inching is performed at 300 [spm], which is the lowest sewing speed in a general sewing machine, and in a case where the "inching" is detected, the operation information in which the "number of stitches" is 1, the "operating hours" is 0.2 [s], and the "sewing speed" is 300 [spm] is acquired. Operating hours t2 during the inching can be set in any manner from the input unit 44.

Figure 6:
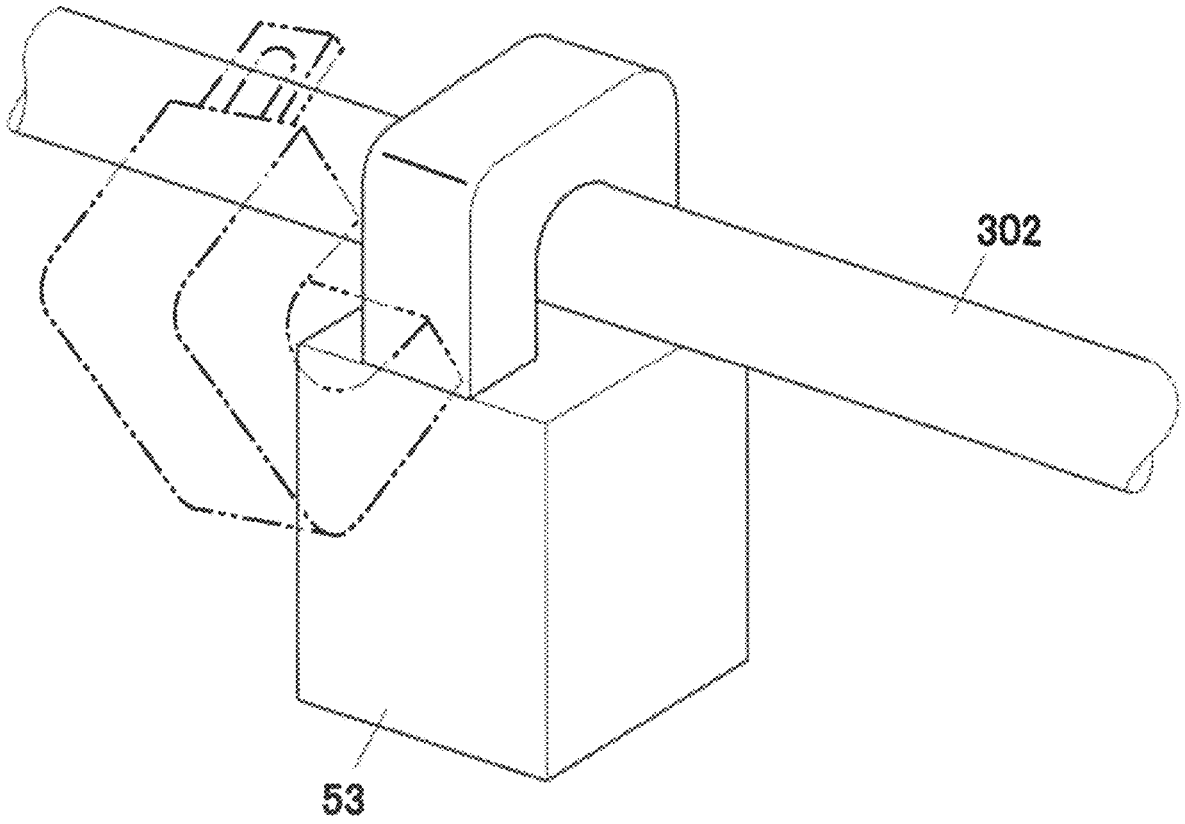
FIG. 6 is a perspective view of a current sensor.

FIG. 6 is a perspective view of the current sensor 53. The current sensor 53 includes an annular portion through which the current cable 302 of the main shaft motor is inserted. The annular portion can be opened by separating one end, as illustrated by the two-dot chain line in FIG. 6, and accordingly, the current cable 302 can be easily inserted.

The current sensor 53 includes an annular magnetic core that can be divided into two parts at the annular portion, a coil in which an annular magnetic core is fitted, and a shunt resistor provided with the coil in parallel, and detects the leakage magnetic flux when the current flows from both end portions of the coil to the current cable 302.

The current sensor 53 can detect the motor current by inserting the current cable 302 drawn to the outside of the sewing machine 30, and therefore, can be easily externally attached or retrofitted to the sewing machine 30 without any modification.

The current sensor 53 is not limited to the current cable 302, but may be attached to other cables leading to the main shaft motor, such as the ground wire of the main shaft motor or the coated cable of the encoder connected to the main shaft motor.

Figure 7:
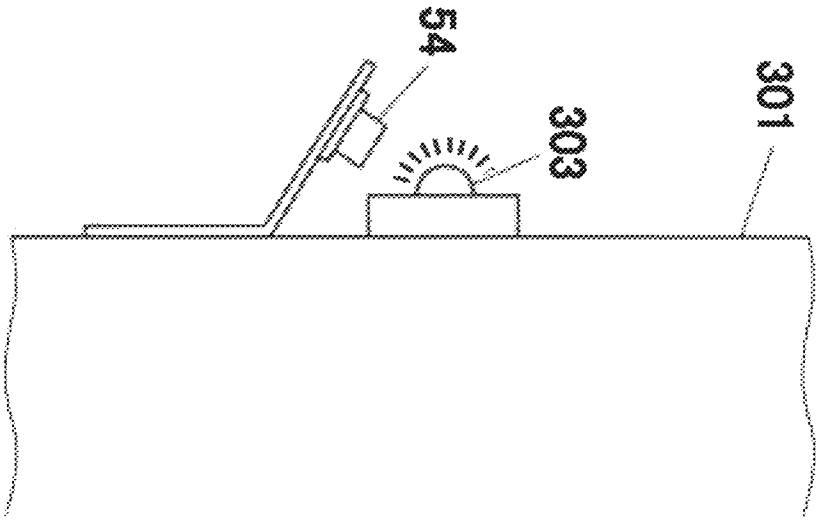
FIG. 7 is a description illustrating an attachment state of an optical sensor.

FIG. 7 is a description view illustrating an attachment state of the optical sensor 54. The optical sensor 54 is formed of a photoelectric conversion element such as a photodiode. Any other sensor can also be used as long as the sensor can detect light.

The optical sensor 54 is provided in an opposing state in the vicinity of the power lamp 303 provided on the surface of the main body frame 301 of the sewing machine 30, the electrical box, and the like, and detects that the main power of the sewing machine is turned on by turning on the power lamp 303.

The optical sensor 54 can be fixed by using any of the methods available, such as gluing, screwing, or screwing through a bracket. The optical sensor 54 may not be directly attached to the surface of the main body frame 301 or the electrical box, and for example, may be configured to be supported by a support erected on the front side of the power lamp 303 of the sewing machine 30.

The optical sensor 54 is not limited to a case of detecting light from the power lamp, and may also detect light from any other configurations of the sewing machine 30 that emits light when the main power is turned on. For example, a state where the main power is turned on may be detected from a display panel or work light that emits light when the main power is turned on.

The optical sensor 54 can detect a state where the main power is turned on by the power lamp or the like that emits light to the outside of the sewing machine 30, and therefore, can be easily externally attached or retrofitted to the sewing machine 30 without any modification.

The volume switch 56 is the same as the one provided in the operation information acquisition device 40E. The volume switch 56 will be described when describing the operation information acquisition device 40E.

A detection device 50B of the operation information acquisition device 40B includes the photoelectronic sensor 51B (refer to FIG. 14), and the current sensor 53, the optical sensor 54, and the volume switch 56 similar to the above-described detection device 50A.

The operation information acquisition device 40B includes at least the photoelectronic sensor 51B as the detection device 50B, but does not include the current sensor 53, the optical sensor 54, or the volume switch 56 in some cases.

In other words, the operation information acquisition device 40B is different from the operation information acquisition device 40A only in the configuration of the photoelectronic sensor 51B. Hereinafter, the configuration of the photoelectronic sensor 51B will be described.

Figure 14:
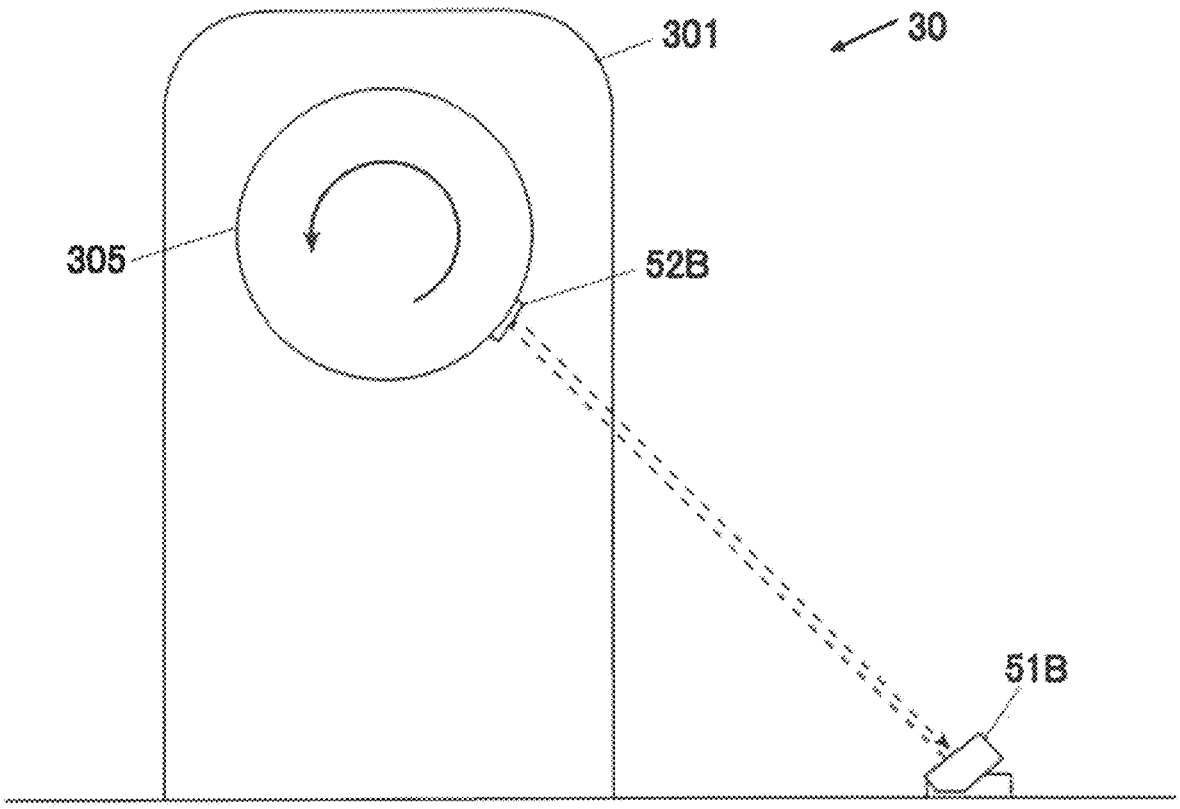
FIG. 14 is a side view of the sewing machine illustrating another installation example of the photoelectronic sensor and illustrates a detection state of the photoelectronic sensor.
Figure 15:
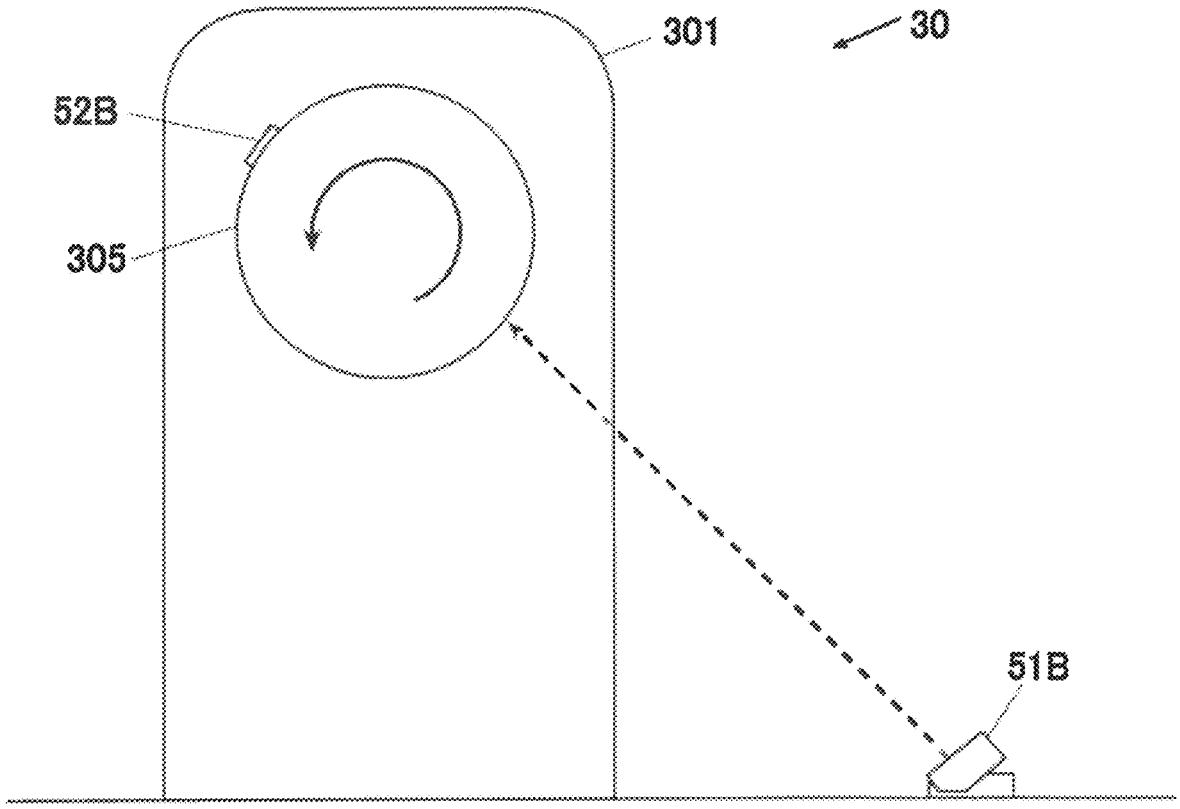
FIG. 15 is a side view of the sewing machine illustrating another installation example of the photoelectronic sensor and illustrates a non-detection state of the photoelectronic sensor.

FIGS. 14 and 15 are side views of the sewing machine 30 illustrating the installation examples of the photoelectronic sensor 51B on the sewing machine 30, FIG. 14 illustrates a detection state of the photoelectronic sensor 51B, and FIG. 15 illustrates a non-detection state.

The photoelectronic sensor 51B detects the rotation of a pulley 305 as an operating member that performs the periodic operation at the same cycle as the up-down movement operation of the sewing needle 307.

The pulley 305 is disposed and exposed on the outside so as to perform the manual operation from the outside, on the side of the main body frame 301. The pulley 305 is connected to the main shaft and rotates in conjunction with the main shaft. Therefore, the pulley 305 rotates at the same cycle as the up-down movement operation of the sewing needle 307.

The photoelectronic sensor 51B is a reflective type including a light emitting element and a light receiving element facing the same direction, and can detect the presence or absence of a detection target by reflecting the detected light from the light emitting element onto the detection target and having the reflected light detected by the light receiving element. Here, a reflective sheet 52B is used such that the detection target is excellently reflected.

The reflective sheet 52B as a reflective portion adheres to a predetermined position on the outer peripheral surface of the pulley 305 or in the vicinity of the outer periphery of the circular end surface, and the photoelectronic sensor 51B is disposed in the vicinity of the sewing machine 30 or on the surface of the main body frame 301 of the sewing machine 30 so as to irradiate the position of the reflective sheet 52B with the detected light at the needle bar upper stop position.

The examples in FIGS. 14 and 15 illustrate an example in which the photoelectronic sensor 51B is installed on the table where the sewing machine 30, which is separated from the pulley 305, is installed such that the pulley 305 does not interfere with the manual operation.

The photoelectronic sensor 51B may be installed to be fixed by using any of the methods available, such as gluing, screwing, or screwing through a bracket, on the surface or the table of the main body frame 301 of the sewing machine 30. The photoelectronic sensor 51B may also be configured to be supported by a support erected on the table, for example.

The photoelectronic sensors 51B and reflective sheet 52B enable the photoelectronic sensor 51B to detect the needle bar upper stop position of the sewing machine 30 from the change in light intensity of the reflected light of the detected light. Specifically, as illustrated in FIG. 14, at the needle bar upper stop position of the sewing machine 30, the reflective sheet 52B reflects the detected light, and the photoelectronic sensor 51B enters a high light intensity detection state. As illustrated in FIG. 15, at a position other than the needle bar upper stop position of the sewing machine 30, the reflective sheet 52B is at the position at which the detected light is not reflected, and thus, the photoelectronic sensor 51B enters a low light intensity detection state.

The detection means for detecting the specific part of the pulley 305 is not limited to the photoelectronic sensor 51B, and any sensor that can detect the approach of the specific part of the pulley 305 to a predetermined position can be used. For example, a protrusion or the like may be provided instead of the reflective sheet 52B of the pulley 305, and the approach of the specific part of the pulley 305 may be detected by the distance detection sensor, or a magnetic material may adhere instead of the reflective sheet 52B on the pulley 305 and detected by a magnetic sensor.

In a case of the photoelectronic sensor 51B, by replacing the detection state of high light intensity with the above-described L state of detection of the photoelectronic sensor 51A and the detection state of low light intensity with the above-described H state of detection of the photoelectronic sensor 51A, it is possible to detect all the operation information described in FIGS. 8 to 13, such as the "operating hours", the "number of stitches", the "sewing speed", the "number of times of thread cutting", and the "volume" (including a case of inching).

A detection device 50C of the operation information acquisition device 40C is an external detection device that detects the state change of the operating member that performs the operation asynchronously with the up-down movement operation of the sewing needle.

Figure 16:
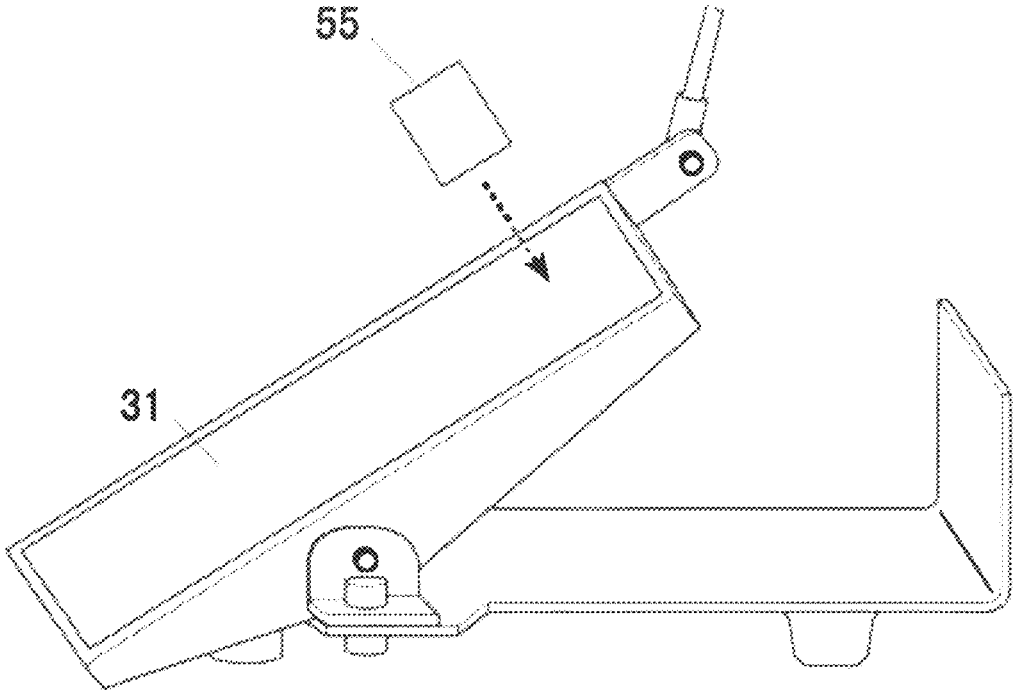
FIG. 16 is a perspective view of a proximity sensor.

Specifically, as illustrated in FIG. 16, the detection device 50C includes a proximity sensor 55 and a volume switch 56, which detect the input operation of an operation pedal 31 to start the sewing of the sewing machine 30 or to activate the main shaft motor.

The operation information acquisition device 40C includes at least the proximity sensor 55 as the detection device 50C, but does not include the volume switch 56 in some cases.

The proximity sensor 55 is disposed opposing a part (for example, the treadle) that is moved closer and farther apart by the operation of the operation pedal 31, and detects the position change of the approach and separation of the part that is moved closer and farther apart.

The proximity sensor 55 may be a sensor capable of detecting the approach or separation of the target optically or magnetically, a distance detection sensor using ultrasonic waves, or a limit switch.

The proximity sensor 55 may be installed to be fixed by using any of the methods available, such as gluing, screwing, or screwing through a bracket, on the table or the floor of the sewing machine 30. The proximity sensor 55 may also be configured to be supported by a support erected on the floor, for example.

When an input operation state where the operation pedal 31 is stepped is detected by the proximity sensor 55, the "operating hours" can be acquired based on the elapsed time of the input operation state.

In a case where the operation pedal 31 is a type that executes the thread cutting by stepping in reverse and the proximity sensor 55 can detect the distance of the target in multiple steps step by step, the thread cutting operation of the operation pedal 31 can be detected, and the "number of times of thread cutting" and the "volume" based on this can be detected.

A detection device 50D of the operation information acquisition device 40D is an external detection device that detects the state change of the operating member that performs the operation asynchronously with the up-down movement operation of the sewing needle.

Specifically, the detection device 50D includes a bobbin installation table, a sensor that detects the rotation of the rotating shaft, and the volume switch 56 in a case where the sewing machine 30 includes a bobbin spool device.

The operation information acquisition device 40D includes at least the bobbin installation table or the sensor that detects the rotation of the rotating shaft as the detection device 50D, but does not include the volume switch 56 in some cases.

The bobbin installation table or the sensor that detects the rotation of the rotating shaft, for example, attaches the reflective sheet to the bobbin installation table or the rotating shaft, similar to the photoelectronic sensor 51B and the reflective sheet 52B described above, and detects the movement of the reflective sheet by the photoelectronic sensor, and accordingly, the operating state and the non-operating state of the spool device are detected.

When the operating state of the spool device is detected by the detection device 50D, the "presence or absence of operation" of the sewing machine 30 in the operation status and the "operating hours" from the operating state of the spool device, can be acquired.

A detection device 50E of the operation information acquisition device 40E is an external detection device that detects the state change of the operating member that performs the operation asynchronously with the up-down movement operation of the sewing needle.

Figure 17:
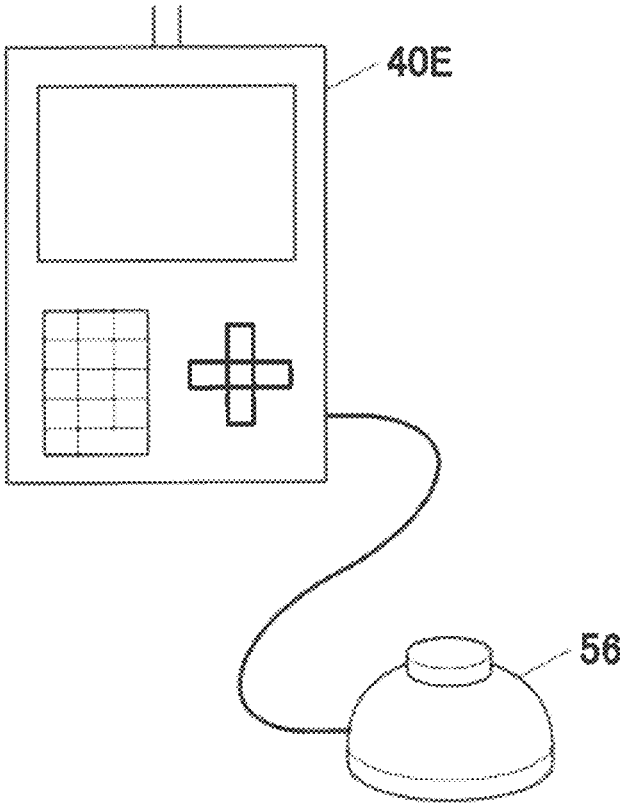
FIG. 17 is a description view of the operation information acquisition device provided in a volume switch.

Specifically, the detection device 50E includes the volume switch 56, as illustrated in FIG. 17.

The volume switch 56 is a switch operated by the operator who works with the sewing machine, and is pressed by the operator every time one operation (process) is completed. By pressing down the volume switch 56, the volume is counted up by one. Accordingly, it is possible to acquire the "volume" as operation information.

[Operation Information Collection Process of Management Server]

Figure 18:
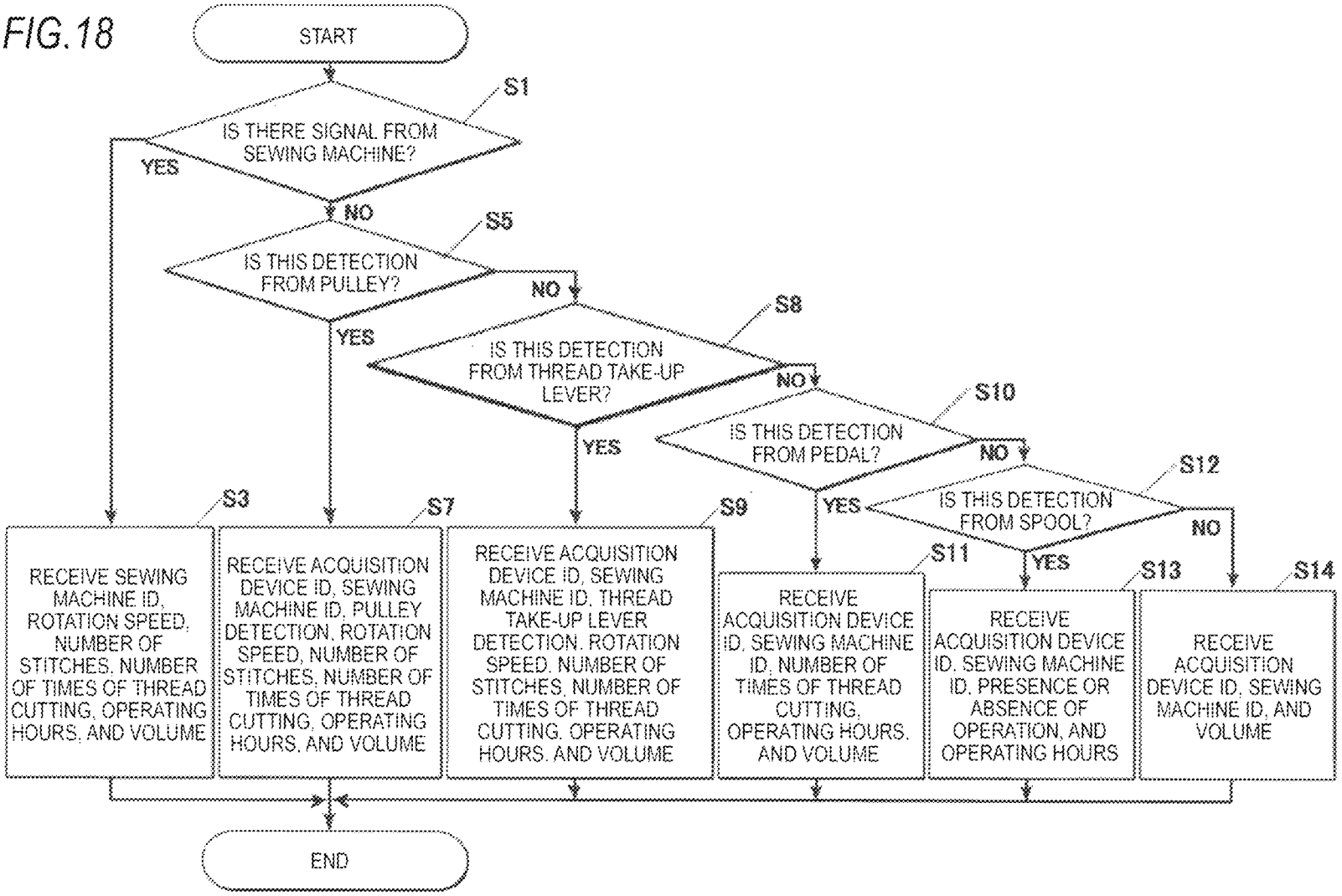
FIG. 18 is a flowchart of an operation information collection process by the management server.

The operation information collection process of the management server 11 will be described based on the flowchart in FIG. 18.

First, the management server 11 requests the currently acquired operation information from each sewing machine 20 and each operation information acquisition device 40 that are connected through the network NW2. This request may be executed periodically, may be executed according to the request of the management terminal 101, or may be performed by the operation of the administrator of the management server 11.

In a case where a response to this request is obtained from either each sewing machine 20 or each operation information acquisition device 40, the management server 11 identifies whether the response signal is from the sewing machine 20 or the operation information acquisition device 40 (step S1).

In a case where the response signal is from the sewing machine 20, by performing an information transmission request, the most recent operation information data including the sewing machine ID, the operating hours, the number of stitches, the sewing speed (rotation speed), the number of times of thread cutting, and the volume of the sewing machine 20 are acquired and stored (step S3). Then, the process is finished.

Meanwhile, in a case where the response signal is not from the sewing machine 20, it is identified whether or not the response signal is the operation information acquisition device 40B that performs the detection from the pulley 305 with respect to the operation information acquisition device 40 (step S5).

In a case where the response signal is the operation information acquisition device 40B (step S5: YES), by performing the information transmission request, the acquisition device ID of the operation information acquisition device 40B, the sewing machine ID installed by the operation information acquisition device 40B, the form information indicating that the device is a type of acquisition device that acquires the operation information from the pulley 305, and the data of the most recent operation information including the operating hours, the number of stitches, the sewing speed (rotation speed), the number of times of thread cutting, and the volume, are acquired and stored (step S7). Then, the process is finished.

Meanwhile, in a case where the response signal is not the operation information acquisition device 40B that performs the detection from the pulley 305 (step S5: NO), the management server 11 identifies whether or not the response signal is the operation information acquisition device 40A that performs the detection from the thread take-up lever member 304 with respect to the operation information acquisition device 40 (step S8).

In a case where the response signal is the operation information acquisition device 40A (step S8: YES), by performing the information transmission request, the acquisition device ID of the operation information acquisition device 40A, the sewing machine ID installed by the operation information acquisition device 40A, the form information indicating that the device is a type of acquisition device that acquires the operation information from the thread take-up lever member 304, and the data of the most recent operation information including the operating hours, the number of stitches, the sewing speed (rotation speed), the number of times of thread cutting, and the volume, are acquired and stored (step S9). Then, the process is finished.

Meanwhile, in a case where the response signal is not the operation information acquisition device 40A that performs the detection from the thread take-up lever member 304 (step S8: NO), the management server 11 identifies whether or not the response signal is the operation information acquisition device 40C that performs the detection from the operation pedal 31 with respect to the operation information acquisition device 40 (step S10).

In a case where the response signal is the operation information acquisition device 40C (step S10: YES), by performing the information transmission request, the acquisition device ID of the operation information acquisition device 40C, the sewing machine ID installed by the operation information acquisition device 40C, the form information indicating that the device is a type of acquisition device that acquires the operation information from the operation pedal 31, and the data of the most recent operation information including the operating hours, the number of times of thread cutting, and the volume, are acquired and stored (step S11). In acquiring the volume data, the volume switch may be detected. Then, the process is finished.

Meanwhile, in a case where the response signal is not the operation information acquisition device 40C that performs the detection from the operation pedal 31 (step S10: NO), the management server 11 identifies whether or not the response signal is the operation information acquisition device 40D that performs the detection from the spool device with respect to the operation information acquisition device 40 (step S12).

In a case where the response signal is the operation information acquisition device 40D (step S12: YES), by performing the information transmission request, the acquisition device ID of the operation information acquisition device 40D, the sewing machine ID installed by the operation information acquisition device 40D, the form information indicating that the device is a type of acquisition device that acquires the operation information from the spool device, and the data of the most recent operation information including the "presence or absence of operation" or the operating hours of the sewing machine, are acquired and stored (step S13). In acquiring the volume data, the volume switch may be detected. Then, the process is finished.

Meanwhile, in a case where the response signal is not the operation information acquisition device 40D that performs the detection from the spool device (step S12: NO), the management server 11 determines that the response signal is the operation information acquisition device 40E that performs the detection from the volume switch 56.

The management server 11 performs the information transmission request with respect to the operation information acquisition device 40E, and the acquisition device ID of the operation information acquisition device 40E, the sewing machine ID installed by the operation information acquisition device 40E, the form information indicating that the device is a type of acquisition device that acquires the operation information from the volume switch 56, and the data of the most recent operation information including the "volume", are acquired and stored (step S14). Then, the process is finished.

In this manner, the management server 11 acquires the operation information with common contents for all of the sewing machines 20 and 30, regardless of the type of sewing machines that configure the sewing line of the sewing factory SP2. For the sewing machine 30, whether the operation information is the operation information acquired from the thread take-up lever member 304 by the operation information acquisition device 40A, the operation information acquired from the pulley 305 by the operation information acquisition device 40B, the operation information acquired from the operation pedal 31 by the operation information acquisition device 40C, the operation information acquired from the spool device by the operation information acquisition device 40D, or the operation information acquired from the volume switch 56 by the operation information acquisition device 40E, can be all distinguished and acquired.

While the operation information acquisition device 40A and the operation information acquisition device 40B can acquire the "volume" from the detection of the photoelectronic sensors 51A and 51B, it is also possible to acquire the "volume" from the input of the volume switch 56. The operation information acquisition device 40A and the operation information acquisition device 40B can be set in advance from the input unit 44 to acquire the "volume" from the detection of the photoelectronic sensors 51A and 51B in advance or to acquire the "volume" from the input of the volume switch 56. Therefore, the operation information acquisition device 40A and the operation information acquisition device 40B transmit the "volume" obtained based on the setting to the management server 11.

The management server 11 transmits the operation information to the management terminal 101 according to the request or periodically for all of the sewing machines 20 and 30 that configure the sewing line of the sewing factory SP2. For the other sewing factories SP1 and SP3, each management server 11 similarly transmits the operation information of all of the sewing machines 20 and 30.

In the management terminal 101, it is possible to acquire the operation information of the sewing machines 20 and 30 belonging to each of the factories SP1 to SP3, and accordingly, it is possible to perform analysis for each of the factories SP1 to SP3, and to perform analysis that contributes to improving the production efficiency, such as improving the line balance.

[Operation Information Acquisition Process by Operation Information Acquisition Device]

Figure 19:
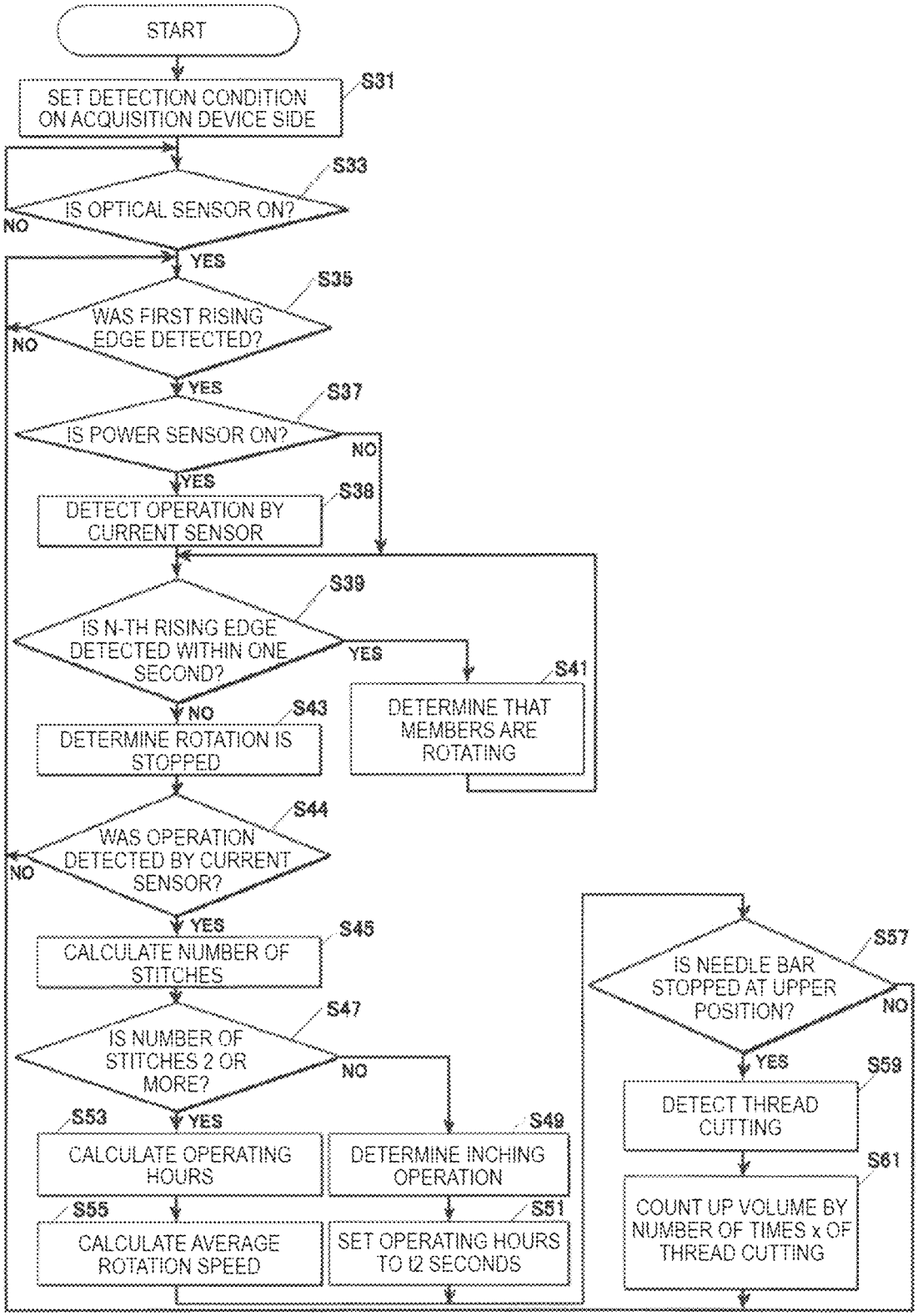
FIG. 19 is a flowchart of an operation information acquisition process by the operation information acquisition device.

The operation information acquisition process of the operation information acquisition device 40A will be described based on the flowchart in FIG. 19. Although the same operation information acquisition process is performed by the operation information acquisition device 40A and the operation information acquisition device 40B, a case of the operation information acquisition device 40A will be exemplified here.

First, in the operation information acquisition device 40A, the setting value necessary for acquiring the operation information is set in advance from the input unit 44 (step S31). The setting values are the stop determination time t1, which is the elapsed time for determining that the main shaft is stopped after the photoelectronic sensor 51A detects the last rising edge Eu, the operating hours t2, which is approximately simulated during the inching, and the number of times x of thread cutting executed when sewing one sewn object, which is a parameter for obtaining the volume.

Next, the control unit 41 determines whether or not the main power of the sewing machine 30 is turned on, from the output of the optical sensor 54 (step S33). In a case where the main power is not detected to be turned on, the above-described determination is continued.

In a case where a state where the main power is not detected to be turned on continues for a predetermined period of time, the control unit 41 records data indicating that the power of the corresponding sewing machine 30 is not turned on and the sewing machine 30 is not in operation (no operation information) in the storage unit 42. In a case where there is a request for the operation information from the management server 11 at this point, the control unit 41 records the information indicating that the sewing machine 30 is not in operation with the current time in the storage unit 42, instead of the operation information.

When the tip end portion of the thread take-up lever member 304 starts to oscillate up and down, the photoelectronic sensor 51A will alternately output the L state and the H state. After the main power is turned on and before the first drive starts, the sewing machine is at the needle bar upper stop position (refer to FIG. 8).

The control unit 41 waits for the detection of the first rising edge Eu from the output of the photoelectronic sensor 51A (step S35).

In a case where the first rising edge Eu is not detected, the detection waiting is repeated, and in a case where the first rising edge Eu is detected, the counting of the rising edge Eu is started.

At this time, the control unit 41 determines whether or not the main shaft motor of the sewing machine 30 is energized by the current sensor 53 (step S37). In a case where the energization to the main shaft motor is detected, the energization detection is stored (step S38), and the process proceeds. In a case where the energization to the main shaft motor is not detected, the energization non-detection is stored and the process proceeds.

Each time the rising edge Eu is detected, the control unit 41 monitors whether or not the next rising edge Eu is detected within the stop determination time t1 (step S39: refer to FIGS. 10 to 12).

In a case where the next rising edge Eu is detected within the stop determination time t1, the control unit 41 determines that the main shaft motor and the main shaft are rotating (step S41). The control unit 41 continues to monitor whether or not the next rising edge Eu is detected within the stop determination time t1.

Meanwhile, in a case where the next rising edge Eu is not detected within the stop determination time t1, it is determined that the main shaft motor and the main shaft are stopped (step S43).

At this time, in a case where the energization to the main shaft motor is detected in step S37, the process proceeds to step S45, and in a case where the energization to the main shaft motor is not detected in step S37, it is determined whether or not the main shaft motor of the sewing machine 30 is energized again (step S44).

In a case where the energization to the main shaft motor is not detected again, the detection of the rising edge Eu in step S39 is assumed to be performed by the manual operation of the pulley 305, and the counting of the rising edge Eu is invalidated and the process returns to step S35.

In a case where the energization to the main shaft motor is detected again, the process proceeds to step S45.

The control unit 41 calculates the number of stitches from the count number of the rising edge Eu from the start to the stop of the driving of the main shaft motor in accordance with the determination of the stop of the main shaft (step S45).

The control unit 41 determines whether the number of stitches from the start to the stop of the driving of the main shaft motor is 2 or more (step S47).

In a case where the number of stitches from the start to the stop of the driving of the main shaft motor is less than 2 (number of stitches=1), the control unit 41 determines the execution of inching (step S49: refer to FIG. 13). In this case, since only one rising edge Eu is detected, the operating hours cannot be calculated from the time interval, and thus, the operating hours are considered to be the preset operating hours t2 during the inching. For example, the "number of stitches" is set to 1, the "operating hours" is set to 0.2 [s], which is one cycle of the lowest sewing speed, and the "sewing speed" is set to 300 [spm], which is the lowest sewing speed (step S51).

Meanwhile, in a case where the number of stitches from the start to the stop of the driving of the main shaft motor is 2 or more, the control unit 41 acquires the "number of stitches" from the number of rising edges Eu and calculates the "operating hours" based on the elapsed time from the first rising edge Eu to the rising edge Eu immediately before the stop (step S53).

Furthermore, the "sewing speed" is calculated by dividing the "number of stitches" by the "operating hours" (step S55).

The control unit 41 determines whether or not the needle bar is stopped at the needle bar upper stop position, from the output of the photoelectronic sensor 51A when the main shaft is stopped (step S57).

In a case where the needle bar is not stopped at the needle bar upper stop position (in a case where the needle bar is stopped at the needle bar lower stop position) (refer to FIG. 11), the sewing is resumed, and thus, the "number of stitches", the "operating hours", and the "sewing speed" up to now are recorded in the storage unit 42 as the operation information together with the current time, and the process returns to step S37 (step S57).

Meanwhile, in a case where the needle bar is stopped at the needle bar upper stop position (refer to FIG. 10 or 12), it is determined that thread cutting is executed, and the "number of times of thread cutting" is counted up (step S59).

Furthermore, in a case where the "number of times of thread cutting" reaches the number of times x of thread cutting to be executed when sewing one sewn object, the "volume" is counted up by one (step S61).

The control unit 41 records the "number of stitches", the "operating hours", the "sewing speed", the "number of times of thread cutting", and the "volume" together with the current time in the storage unit 42 as the operation information, and the process returns to step S37.

After this, the same process is repeated, and the operation information is sequentially accumulated.

Technical Effects of Embodiments of Present Invention

The operation information acquisition devices 40A and 40B of the above-described operation information collection system 10 acquire the operation information by detecting the state change of the thread take-up lever member 304 or the pulley 305 by the photoelectronic sensors 51A and 51B on the outer side of the main body frame 301 of the sewing machine 30. Therefore, for sewing machine 30 that does not have a function of acquiring the operation information or outputting the operation information to the outside, it is possible to easily acquire the operation information by retrofitting and externally attaching the photoelectronic sensors 51A and 51B without any modification.

The operation information acquisition devices 40C and 40D include: the operation pedal 31 as the operating member which is provided on the outer side of the main body frame 301 of the sewing machine 30 and performs the operation asynchronously with the up-down movement operation of the sewing needle; and the detection devices 50C and 50D as the external detection devices that detect the state change of the spool device, and acquire the operation information based on these detection results. Therefore, for the sewing machine 30 that does not have a function of acquiring the operation information or outputting the operation information to the outside, it is possible to easily acquire the operation information by retrofitting and externally attaching the detection devices 50C and 50D without any modification.

The operation information acquisition device 40E acquires the operation information based on the input of the volume switch 56 provided on the outer side of the main body frame 301 of the sewing machine 30. Therefore, for sewing machine 30 that does not have a function of acquiring the operation information or outputting the operation information to the outside, it is possible to easily acquire the operation information by retrofitting and externally attaching the volume switch 56 without any modification.

Since the operation information acquisition device 40B acquires the operation information by detecting the state change of the pulley 305, it is also possible to dispose the photoelectronic sensor 51B in any of the surrounding areas of the pulley 305, and it is possible to easily perform the installation work with a high degree of freedom in the installation of the device.

Since the operation information acquisition device 40A acquires the operation information by detecting the state change of the thread take-up lever member 304, it is possible to detect the state change from the presence or absence of the thread take-up lever member 304, and to perform excellent detection even in a case where a reflective sheet is not used. Therefore, the installation work is easy and it is possible to acquire the operation information with high reliability.

Since the top dead point of the tip end portion of the thread take-up lever member 304 is the needle bar upper stop position, the attachment position of the photoelectronic sensor 51A can be easily obtained, and it is possible to reduce the burden of the installation work.

The photoelectronic sensors 51A and 51B are configured to detect the tip end portion of the thread take-up lever member 304 or the adhering position of the reflective sheet 52B of the pulley 305 at a predetermined detection position, for example, the needle bar upper stop position. Therefore, it is possible to detect the state of the sewing machine 30, such as whether or not the needle bar is at the needle bar upper stop position, and to acquire more information as the operation information.

For example, it is possible to acquire the "number of stitches" based on the periodically detected rising edge Eu from simple detection information of H and L, similar to the photoelectronic sensors 51A and 51B.

Furthermore, it is possible to acquire the "operating hours" from the time interval of the rising edge Eu, and to acquire the "sewing speed" from the "number of stitches" and the "operating hours".

The "number of times of thread cutting" can be acquired by determining whether or not the needle bar is at the needle bar upper stop position which is the predetermined detection position. Furthermore, it is possible to acquire the "volume" from the "number of times of thread cutting".

The operation information acquisition devices 40A and 40B can detect the inching by the number of stitches=1, and can acquire the "number of stitches", the "operating hours", and the "sewing speed" when sewing the inching.

Since the operation information acquisition devices 40A and 40B include the current sensor 53 that detects the energization from the outer side of the current cable of the main shaft motor, the current sensor 53 can be externally attached and retrofitted to detect the energized state of the motor current without any modification to the sewing machine 30.

Accordingly, it is possible to detect the operation status of the main shaft motor, and by acquiring the operation information in combination with the detection, for example, during the non-sewing (for example, during the adjustment work), it is possible to avoid the acquisition of wrong operation information, and to improve the reliability of the acquired operation information.

The operation information acquisition devices 40A and 40B can detect the unused state where the main power is not turned on, because the optical sensor 54 detects the light emitting state from the power lamp 303 and the like of the sewing machine 30. Accordingly, it is possible to obtain the material for grasping the use situation of the sewing machine 30.

Since the operation information acquisition devices 40A, 40B, and 40E include the volume input switch 56 that detects the volume by the operation of the operator who works with the sewing machine, compared to a case where the volume is obtained by speculatively detecting the execution of the thread cutting from the stop position of the operation of the sewing needle, more accurate volume can be acquired.

Since the operation information collection system 10 includes the operation information acquisition device 40, it is possible to acquire the operation information from a wide variety of plural sewing machines 20 and 30, regardless of the presence or absence of a function for acquiring the operation information.

The operation information collection system 10 can acquire the operation information including the parameters such as the "number of stitches", the "operating hours", and the "sewing speed", which are equivalent for different types of sewing machines 20 and 30, and it is possible to grasp the operation status of different types of sewing machines 20 and 30 without distinguishing therebetween, and to analyze the grasped operating situation for each sewing line.

Since the sewing management system 1 can acquire the operation information for almost all of the sewing machines 20 and 30 belonging to each of the sewing factories SP1 to SP3, it is possible to grasp the operating situation in each of the sewing factories SP1 to SP3 more precisely. From these, it is possible to perform the analysis for each of the factories SP1 to SP3 and perform more detailed analysis that contributes to improving production efficiency, such as improving the line balance.

OTHERS

The details illustrated in the above-described embodiment can be changed as appropriate without departing from the spirit of the invention.

For example, in the above-described operation information collection system 10, the sewing machine 20 or the operation information acquisition device 40 may be configured to acquire the detection information by encoders or the photoelectronic sensors 51A and 51B, and the management server 11 may be configured to perform all the processing to calculate the operation information from these detection information.

In the above-described operation information acquisition device 40A, a case where the reflective sheet 52A is provided at the tip end portion of the thread take-up lever member 304 and detected by the photoelectronic sensor 51A is exemplified, but the thread take-up lever member 304 may be directly detected by the photoelectronic sensor 51A without providing the reflective sheet. When a distance measurement sensor is used instead of the photoelectronic sensor 51A, the reflective sheet 52A is not necessary.

In the detection device 50B, an example is illustrated in which the photoelectronic sensor 51B is disposed to irradiate the position of the reflective sheet 52B at the needle bar upper stop position with the detected light, but the photoelectronic sensor 51B may be disposed such that the position of the reflective sheet 52B at the needle bar lower stop position is irradiated with the detected light. In this case, the position when the reflective sheet 52B is detected is determined as the needle bar lower stop position, and the position when the reflective sheet 52B is not detected is determined as the needle bar upper stop position. The angular range of the reflective sheet 52B in the peripheral direction may be narrow, but may also be somewhat wide. For example, the angular range may be a range from a few degrees to several tens of degrees.

What is claimed is:

1. An operation information acquisition device comprising:

an external detection device that is provided on an outer side of a main body frame of a sewing machine and detects a state change of an operating member that performs a periodic operation at a same cycle as an up-down movement operation of a sewing needle; and a controller that executes processing or control for acquiring predetermined detection information, wherein the sewing machine includes:

a main shaft motor;

a main shaft that is rotationally driven by the main shaft motor;

a needle bar and the sewing needle that reciprocate and move up and down by obtaining power from the main shaft;

the operating member that performs the periodic operation at the same cycle as the up-down movement operation of the sewing needle; and a photoelectronic sensor that detects the periodic operation of the operating member, wherein the controller detects a rising edge from an output of the photoelectronic sensor and monitors whether a next rising edge is detected within a stop determination time, wherein in a case where the next rising edge is detected within the stop determination time, the controller determines that the main shaft motor and the main shaft are rotating, and continues to monitor whether the next rising edge is detected within the stop determination time, wherein in a case where the next rising edge is not detected within the stop determination time, the controller determines that the main shaft motor and the main shaft are stopped, and wherein the operation information acquisition device acquires operation information based on detection result of the external detection device.

2. The operation information acquisition device according to claim 1, wherein the operating member is a thread take-up lever member.

3. The operation information acquisition device according to claim 1, wherein the operating member is a pulley that rotates in conjunction with a main shaft.

4. The operation information acquisition device according to claim 1, wherein the external detection device detects a specific part of the operating member at a predetermined detection position.

5. The operation information acquisition device according to claim 4, wherein the operation information acquisition device calculates operating hours of the sewing machine as the operation information based on an elapsed time when continuous detection is performed with respect to the specific part.

6. The operation information acquisition device according to claim 4, wherein the operation information acquisition device calculates a number of stitches of the sewing machine as the operation information based on a number of times of detection of the specific part.

7. The operation information acquisition device according to claim 4, wherein the operation information acquisition device calculates a sewing speed as the operation information based on an elapsed time when continuous detection is performed with respect to the specific part and a number of times of detection of the specific part.

8. The operation information acquisition device according to claim 4, wherein the external detection device detects the specific part of the operating member at the detection position corresponding to a needle bar upper stop position or a needle bar lower stop position, and the operation information acquisition device acquires execution of thread cutting as the operation information based on detection of stop at the needle bar upper stop position or the needle bar lower stop position.

9. The operation information acquisition device according to claim 4, wherein the operation information acquisition device detects execution of inching in a case where a number of times of detection of the specific part is stopped once, and in a case where the inching is detected, the operation information acquisition device acquires the operation information in response to the inching.

10. The operation information acquisition device according to claim 1, further comprising:

a current detection device that detects energization from an outer side of a cable which is drawn to the outer side of the main body frame and connected to a main shaft motor, wherein the operation information acquisition device acquires an operation status of the main shaft motor.

11. The operation information acquisition device according to claim 1, further comprising:

a light detection device that detects a light emitting state of a light emitting unit that emits light when a main power of the sewing machine is turned on, wherein the operation information acquisition device detects a main power-on state of the sewing machine.

12. The operation information acquisition device according to claim 1, further comprising:

a volume input unit configured to detect a volume by an operation of an operator who works with the sewing machine.

13. An operation information acquisition method comprising:

acquiring operation information from an operating member that performs a periodic operation at a same cycle as an up-down movement operation of a sewing needle, on an outer side of a main body frame of a sewing machine, wherein the sewing machine includes:

a main shaft motor;

a main shaft that is rotationally driven by the main shaft motor;

a needle bar and the sewing needle that reciprocate and move up and down by obtaining power from the main shaft;

the operating member that performs the periodic operation at the same cycle as the up-down movement operation of the sewing needle; and a photoelectronic sensor that detects the periodic operation of the operating member, wherein the operation information acquisition method further comprising:

detecting a rising edge from an output of the photoelectronic sensor and monitoring whether a next rising edge is detected within a stop determination time, determining that the main shaft motor and the main shaft are rotating in a case where the next rising edge is detected within the stop determination time, and continuing to monitor whether the next rising edge is detected within the stop determination time, and determining that the main shaft motor and the main shaft are stopped in a case where the next rising edge is not detected within the stop determination time.

14. An operation information collection system that collects operation information from a plurality of sewing machines, comprising:

an external detection device that is provided on an outer side of a main body frame of a sewing machine and detects a state change of an operating member that performs a periodic operation at a same cycle as an up-down movement operation of a sewing needle, the external detection device provided to some or all of the plurality of sewing machines; and a controller that executes processing or control for acquiring predetermined detection information, wherein each sewing machine of the plurality of sewing machines includes:

a main shaft motor;

a main shaft that is rotationally driven by the main shaft motor;

a needle bar and the sewing needle that reciprocate and move up and down by obtaining power from the main shaft;

the operating member that performs the periodic operation at the same cycle as the up-down movement operation of the sewing needle; and a photoelectronic sensor that detects the periodic operation of the operating member, wherein the controller detects a rising edge from an output of the photoelectronic sensor and monitors whether a next rising edge is detected within a stop determination time, wherein in a case where the next rising edge is detected within the stop determination time, the controller determines that the main shaft motor and the main shaft are rotating, and continues to monitor whether the next rising edge is detected within the stop determination time, wherein in a case where the next rising edge is not detected within the stop determination time, the controller determines that the main shaft motor and the main shaft are stopped, and wherein the operation information collection system acquires the operation information based on detection result of each external detection device provided to some or all of the plurality of sewing machines.

15. The operation information collection system according to claim 14, wherein the operation information collection system acquires the operation information based on the detection result of each external detection device provided to some or all of the plurality of sewing machines, and the operation information collection system acquires the operation information based on the detection result of a mounting-type detection device, which is different from the external device, that is mounted on some or all of the sewing machines of the plurality of sewing machines and detects a state change of a configuration of each sewing machine provided with mounting-type detection device.

16. The operation information collection system according to claim 14, wherein the operation information collection system acquires the operation information based on the detection result of each external detection device provided to some or all of the plurality of sewing machines, the operation information collection system further comprising:

another external detection device which is provided on the outer side of the main body frame of the sewing machine and detects a state change of an operating member that performs an operation asynchronously with the up-down movement operation of the sewing needle, is provided to some or all of the plurality of sewing machines, and the operation information collection system acquires the operation information based on detection result of each another external detection device provide to some or all of the plurality of sewing machines.

* * * * *